US007744075B2

(12) United States Patent
Hata

(10) Patent No.: US 7,744,075 B2
(45) Date of Patent: Jun. 29, 2010

(54) BOOKBINDING SYSTEM

(75) Inventor: Kiyoshi Hata, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 24 days.

(21) Appl. No.: 12/128,002

(22) Filed: May 28, 2008

(65) Prior Publication Data

US 2009/0127765 A1 May 21, 2009

(30) Foreign Application Priority Data

Nov. 16, 2007 (JP) ..... 2007-297787

(51) Int. Cl.
*B65H 33/04* (2006.01)
*B65H 39/00* (2006.01)

(52) U.S. Cl. ..... 270/58.07; 270/58.08; 270/58.23

(58) Field of Classification Search ..... 270/58.07, 270/58.08, 58.23
See application file for complete search history.

(56) References Cited

U.S. PATENT DOCUMENTS

2007/0031213 A1* 2/2007 Sasamoto et al. ..... 412/9
2007/0045928 A1* 3/2007 Yoshie et al. ..... 270/58.08

FOREIGN PATENT DOCUMENTS

JP 2006-347695 A 12/2006
JP 2007-62145 A 3/2007

OTHER PUBLICATIONS

Japanese Office Action dated Jul. 28, 2009 (3 pages), and English translation thereof (3 pages), issued in counterpart Japanese Application Serial No. 2007-297787.

* cited by examiner

*Primary Examiner*—Gene Crawford
*Assistant Examiner*—Yolanda Cumbess
(74) *Attorney, Agent, or Firm*—Frishauf, Holtz, Goodman & Chick, P.C.

(57) ABSTRACT

A bookbinding system to produce booklets, including: an image forming section; a first conveyance route of the sheet carrying the image; a sheet storing section which stores sheets on which no image is going to be formed; a second conveyance route to connect the sheet storing section and the first conveyance route; a notching section which forms notches on edges of the sheets; and a bookbinding section which accumulates the sheets to form a sheet bundle, and adhere a cover sheet to the sheet bundle to become a booklet, wherein the image forming section is placed upstream of a merging point of the first and second conveyance routes, with respect to a sheet conveyance direction of the first conveyance route, wherein the notching section is placed downstream of the merging point; and the bookbinding section is placed downstream of the notching section, with respect to the sheet conveyance direction.

8 Claims, 11 Drawing Sheets

BOOKBINDING SYSTEM

CROSS REFERENCE TO RELATED APPLICATION

This application is based on Japanese Patent Application No. 2007-297787 filed on Nov. 16, 2007 with the Japanese Patent Office, the entire content of which is hereby incorporated by reference.

TECHNICAL FIELD

The present invention relates to a bookbinding system to produce booklets.

BACKGROUND OF THE INVENTION

In recent years, various technologies have been provided in which a plurality of recording sheets carrying images are stacked to be a sheet bundle, after which cover sheets are attached by adhesive onto said sheet bundle to become a booklet.

For example, there is one technology in which a user stacks a plurality of sheets carrying images to be one sheet bundle, after which the user sets said sheet bundle and the cover sheets onto the bookbinding machine, whereby a booklet is produced by said bookbinding machine.

Further, in a bookbinding system incorporating an image forming apparatus, such as a copy machine and a printer, there is a technology in which a plurality of recording sheets carrying images are automatically stacked to be one sheet bundle, after which a cover sheet is attached onto said sheet bundle by the adhesive. In said bookbinding system, the general procedure to produce a booklet is, firstly, a plurality of recording sheets carrying images are stacked and aligned to become a sheet bundle. After that, adhesive is applied onto the end portion of said sheet bundle. A cover sheet is conveyed to a predetermined position, so that the cover sheet can be adhered to the end portion of the sheet bundle. By the above procedure, the plurality of sheets and the cover sheet are united so that a booklet is produced.

FIGS. 11 (*a*) and (*b*) show an example of a booklet which is structured of a sheet bundle and a cover sheet.

FIG. 11(*a*) shows a status of cover sheet CO which is not yet folded, while FIG. 11(*b*) shows a status where cover sheet CO has been folded. As shown in FIG. 11(*a*), a bundle of sheets S, carrying the adhesive on its end portion is moved in an arrowed direction to be adhered to cover sheet CO, after which the sheet bundle is covered with cover sheet CO like a U-shape. In the finished status of booklet MA, edge SE of sheets S is aligned to edge COE of cover sheet CO.

However, after the adhesive is applied onto end portion SB of the sheet bundle, cover sheet CO is adhered to the sheet bundle. Occasionally a problem may occur in which sufficient adhesive force between cover sheet CO and end portion SB cannot be obtained, whereby some sheets S may drop from booklet MA.

One method to overcome this problem is that notches are formed on the edges of sheets S corresponding to end portion SB of the sheet bundle, so that the amount of adhesive to be applied onto end portion SB can be increased, whereby the sufficient adhesive force between sheets S and cover sheet CO is obtained.

In the above-described bookbinding machine, it may be possible to provide a mechanism to form the notches on the end portion of the sheet bundle introduced in said machine, and also in the above-describe bookbinding system, it may be possible to provide a notch forming means along the conveyance route of the sheet carrying images, to form the notches, as described in Unexamined Japanese Patent Application Publication No. 2007-62145.

However, general bookbinding machines tend to be quite large-sized, which incorporate a mechanism to align the sheet bundle which has been set, and said general bookbinding machines will be larger-sized by incorporating the notch forming mechanism, as well as a mechanism to collect sheet chips generated by said notch forming mechanism.

Further, in the bookbinding system of the above-described Patent Document, only the sheets on which images are formed by the image forming apparatus, are notched so that the booklet is produced. Accordingly, said bookbinding system cannot produce a booklet by such procedures that sheets carrying no image are introduced between the sheets on which images have been formed by the image forming apparatus, after which the sheets carrying image and the sheets carrying no image are notched and combined to become a booklet. Yet further, said bookbinding system cannot produce a booklet using only sheets on which no image has been formed by said image forming apparatus. Accordingly if the user is required to produce various kinds of booklets, said bookbinding system cannot be used.

SUMMARY OF THE INVENTION

A bookbinding system as an aspect of the present invention is a bookbinding system to produce a booklet, which includes:

an image forming section which forms an image on a sheet;

a first conveyance route serving as a conveyance route of the sheet on which the image has been formed by the image forming section;

a sheet storing section which stores sheets on which no image is going to be formed by the image forming section;

a second conveyance route serving as a sheet conveyance route to connect said sheet storing section and said first conveyance route;

a notch forming section which forms notches on edges of the conveyed sheet; and a bookbinding section which accumulates the conveyed sheets to form a sheet bundle, and adhere a cover sheet to said sheet bundle to become a booklet, wherein said image forming section is placed upstream of a merging point of said first conveyance route and said second conveyance route, with respect to a sheet conveyance direction of said first conveyance route;

wherein said notching section is placed downstream of said merging point, with respect to a sheet conveyance direction; and wherein said bookbinding section is placed downstream of said notching section, with respect to the sheet conveyance direction.

DETAILED DESCRIPTION OF THE PREFERRED EMBODIMENT

Figure 1:
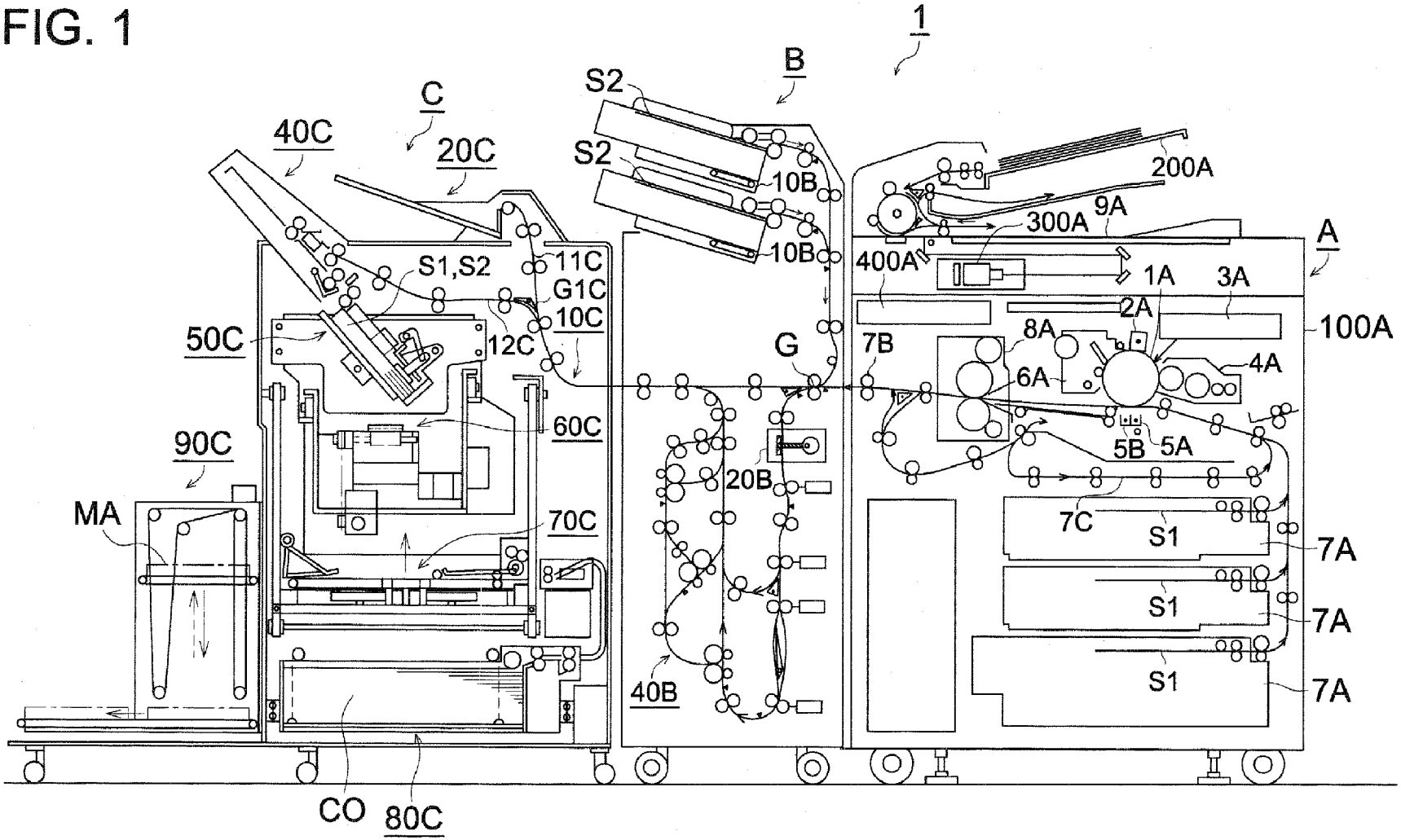
FIG. 1 is a cross-sectional view of a bookbinding system relating to the present invention.

FIG. 1 is a cross-sectional view of bookbinding system 1 relating to the present invention.

Bookbinding system 1 is structured of image forming apparatus A, sheet folding apparatus B, and bookbinding apparatus C.

Image forming apparatus A, which forms an image on sheet S1 using an electro-photographic method, includes image forming section 100A, original document feeding device 200A, image reading section 300A, and communication section 400A. In image forming section A, electrical charging section 2A, exposure section 3A, development section 4A, image transfer section 5A, sheet separating section SB, and cleaning section 6A are positioned around cylindrical photoconductor 1A. These sections conduct the electrical charging operation, exposure, development, and image transfer, to form a toner image on sheet S1.

Various sizes of Sheets S1 are stored in three sets of sheet supplying trays 7A, from which individual sheet S1 is conveyed to image forming section 100A. Sheet S1 carrying the toner image is conveyed to fixing section 8A, where the toner image is permanently fixed on sheet S1. After that, sheet S1 is elected outside of image forming apparatus A, or conveyed to sheet reversing route 7C.

Additionally, image forming apparatus A of the present embodiment forms a monochromatic image on the recording sheet by the electro-photographic method. However, the image forming apparatus relating to the present invention is not limited to the present embodiment, that is, a full color image forming apparatus is as a matter of course usable, further, image forming methods other than the electro-photographic method are usable.

Sheet S1, ejected from image forming apparatus A, is conveyed to sheet folding apparatus B, wherein the punching process, the notching process, or the folding process is conducted in accordance with job setting inputted by an operator. Among other sheets S2, prepared above sheet folding apparatus B, sheet S2 is sequentially supplied as needed.

Bookbinding apparatus C stacks a plurality of sheets S1 and S2, conveyed from folding apparatus B, to form a sheet bundle, after which it adheres cover sheet CO to an edge of said sheet bundle, and then folds cover sheet CO into a U-shape to cover said sheet bundle, whereby booklet MA is produced. Said bookbinding apparatus C incorporates sheet reversing section 40C, sheet stacking section 50C, adhesive coating section 60C, joining section 70C to adhere cover sheet CO to the sheet bundle, conveyance section 10C, ejection tray 20C, coversheet storing section 80C, and ejected booklet storing section 90C.

Sheets S1 and S2, conveyed from bookbinding apparatus C, are ejected onto ejection tray 20C through ejection route 11C by the action of switching gate G1C provided on conveyance section 10C, or conveyed to sheet reversing section 40C through conveyance route 12C. If a bookbinding command is not set on bookbinding apparatus C, sheets S1 and S2 are ejected onto ejection tray 20C. If the bookbinding process is to be conducted in bookbinding apparatus C, sheets S1 and S2 are conveyed to sheet reversing section 40C through conveyance route 12C, sheets S1 and S2 are then switched back in sheet reversing section 40C, and conveyed to stacking section 50C. After a preset number of sheets S1 and S2 are stacked, stacking section 50C rotates to vertically hold sheets S1 and S2. Subsequently, coating section 60C coats the lower surface being the end portion of the bundle of Sheets S1 and S2 with adhesive, and joining section 70C joins cover sheet CO onto the lower surface of stacked sheets S1 and S2. Booklet MA, including bundled sheets S1 and S2 covered with cover sheet CO, is then ejected onto ejected booklet storing section 90C.

Figure 2:
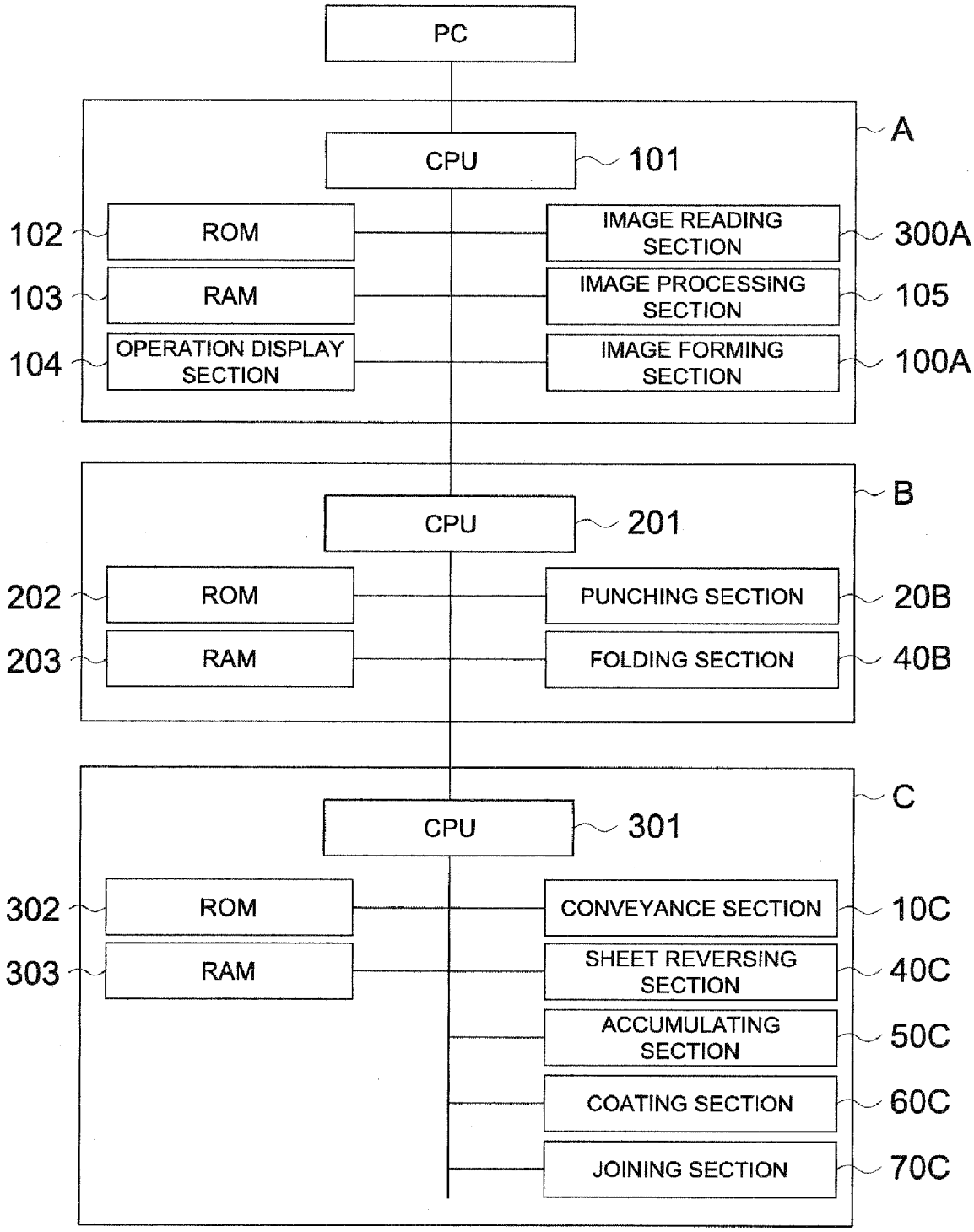
FIG. 2 is a block diagram of a control system of the bookbinding system relating to the present invention.

FIG. 2 is a block diagram of a control system of bookbinding system 1, showing typical controls.

Image forming apparatus A is connected with sheet folding apparatus B, bookbinding apparatus C, and terminal PC, such as a personal computer.

CPU (Central Processing Unit) 101 controls the total operations of bookbinding system 1, being connected to ROM (Read Only Memory) 102, RAM (Random Access Memory) 103, or the like. Said CPU 101 reads out various control programs stored in ROM 102, and expands them into RAM 103, to control the operation of each section. Further, CPU 101 conducts the various processes based on the programs expanded on RAM 103, and stores the conducted results in RAM 103. Yet further, CPU 101 saves the conducted results into predetermined designations. In addition, in the present embodiment, CPU 101 works with ROM 102 and RAM 103 to structure the control section.

Image data produced by image reading section 300A, and image data sent from terminal PC connected to image forming apparatus A, are processed by image processing section 105. Image forming section 100A receives the image data processed by image processing section 105, and forms an image on sheet S1.

CPU 201 controls the total operations of sheet folding apparatus B, which conducts a punching process and a notching process at a predetermined timing, based on signals sent from image forming apparatus A. CPU 201 reads out the various control programs stored in ROM 202, and expands them into RAM 203, to control the various operations of sheet punching section 20B and folding section 40B.

In the same way as the above, CPU 301 controls the total operations of bookbinding apparatus C, which conducts the bookbinding process at a predetermined timing, based on signals sent from image forming apparatus A. CPU 301 reads out the various control programs stored in ROM 302, and expands them into RAM 303, to control the various operations of adhesive coating section 60C and joining section 70C.

Figure 3:
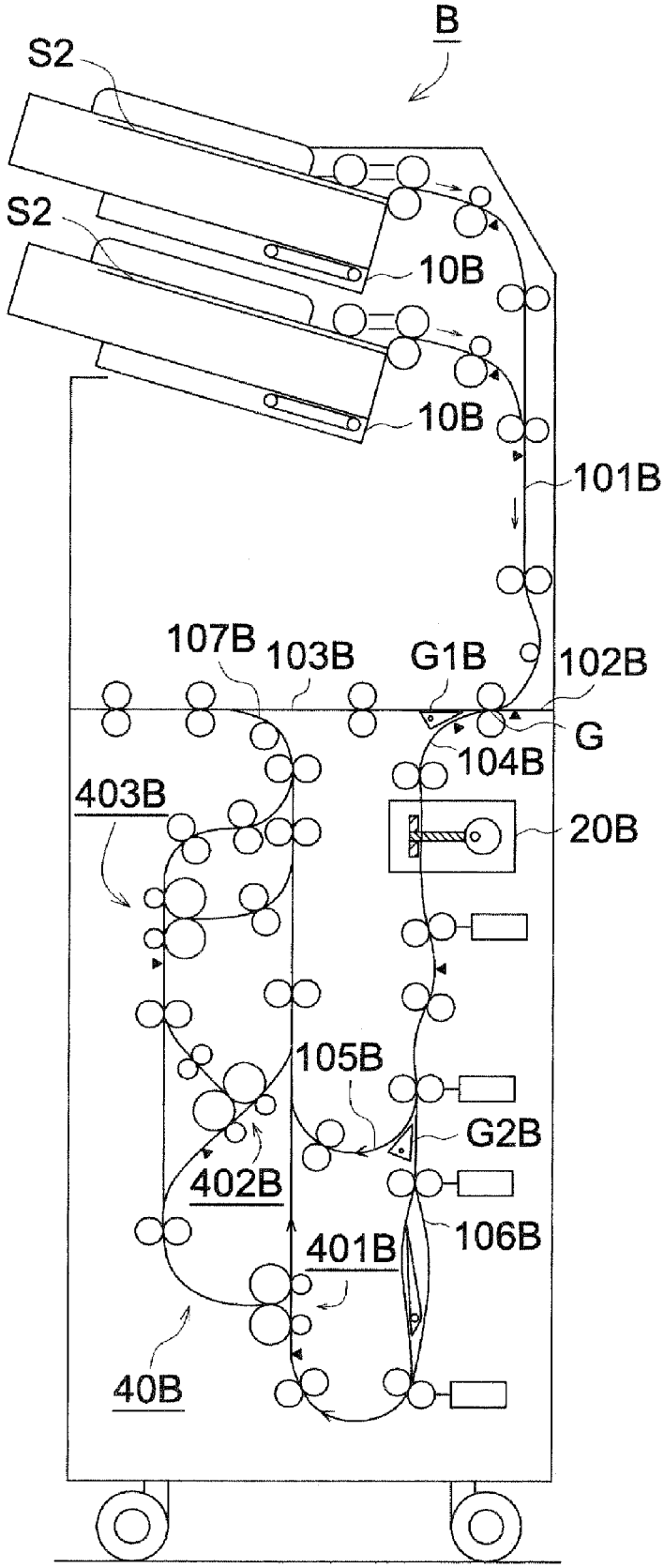
FIG. 3 is a total schematic view of a sheet folding apparatus.

FIG. 3 is a total schematic view of sheet folding apparatus B.

Sheet S, conveyed from image forming apparatus A through conveyance route 102B (which is a first conveyance route), is further conveyed to conveyance route 103B or conveyance route 104B, by the action of switching gate G1B.

Sheet storing sections 10B, mounted on a top section of folding apparatus B, store sheets S2 which are inserted between sheets S1 on which images have already been formed (in this system, images are not formed on sheets S2 by image forming apparatus A), or sheets S2 are used for structuring a booklet. Sheet S2, stored in sheet storing section 10B, is conveyed one by one to merging point G positioned at conveyance route 102B through conveyance route 101B (which is a second conveyance route). After that, sheet S2 is conveyed to conveyance route 103B or conveyance route 104B by the action of switching gate G1B, which is the same way as the case of sheet S1.

If the job to be conducted in bookbinding system 1 includes a punching process, a notching process, or a folding process, gate G1B is switched to close conveyance route 103B, and to convey sheets S1 and S2 to conveyance route 104B.

If the job to be conducted in bookbinding system 1 does not include a punching process, a notching process, or a folding process, gate G1B is switched to close conveyance route 104B, and to convey sheets S1 and S2 to conveyance route 103B.

Sheet punching section 20B, serving as the notching section, is provided on conveyance route 104B. Holes or notches are formed on sheets S1 and S2 according to predetermined stopping positions in the sheet punching section 20B.

When sheets S1 and S2, having processed in sheet punching section 20B, are not to be folded, sheets S1 and S2 are conveyed to conveyance route 105B, which has previously been opened by switching gate G2B, and are conveyed to bookbinding apparatus C. When sheets S1 and S2 are to be folded, sheets S1 and S2 are conveyed to folding section 40B through conveyance route 106B which has previously been opened by switching gate G2B.

Folding section 40B includes three folding sections which are first folding section 401B, second folding section 402B, and third folding section 403B. After each sheet is folded as a center fold, a Z fold, a letter fold, four-fold or double-parallel fold, folded sheets S1 and S2 are returned to conveyance route 103 through conveyance route 107B.

Figure 4:
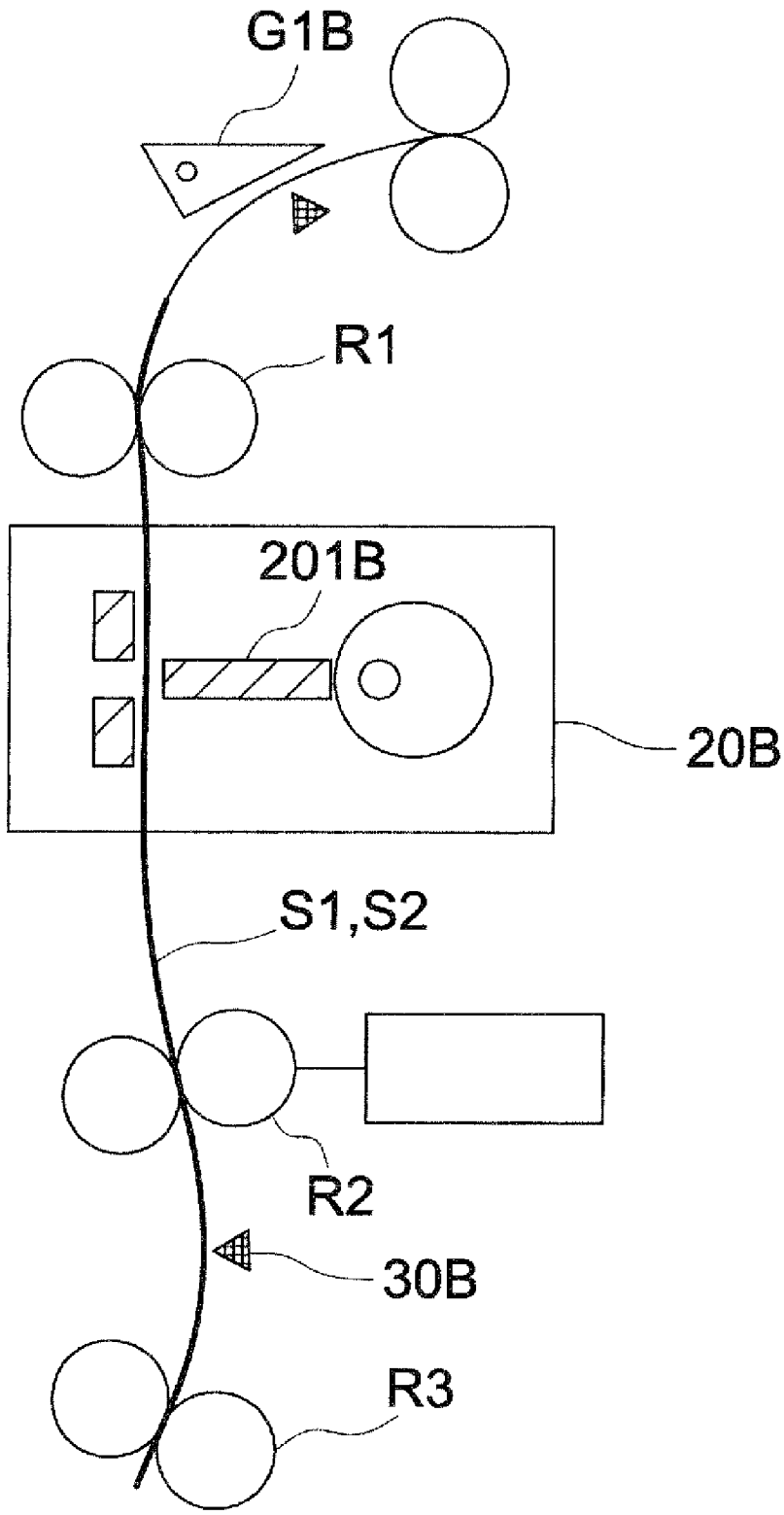
FIG. 4 is an enlargement of a sheet punching section and its relating sections.

FIG. 4 is an enlargement of sheet punching section 20B and its relating sections.

In the case that the job to be conducted in bookbinding system 1 includes a punching process or a notching process, conveyed sheets S1 and S2 are stopped at a predetermined position of sheet punching section 20B by paired rollers R1, R2 and R3, whereby the holes are formed by punches 201B, or the notches are formed on the edges of sheets S1 and S2.

Paired conveyance rollers R1, R2 and R3 are driven by a common motor, which is not shown. After sheet detector 30B detects the leading edge of sheets S1 and S2, the number of steps conducted by said motor is counted so that sheets S1 and S2 are appropriately stopped at the punching position or the notching position.

The cross-sectional view of punch 201B is round. When sheets S1 and S2 are to be punched, sheets S1 and S2 are stopped at the predetermined punching position, and round holes are formed, while when sheets S1 and S2 are to be notched, sheets S1 and S2 are stopped at the predetermined notching position (being different from the punching position), and half round notches are formed.

Figure 5:
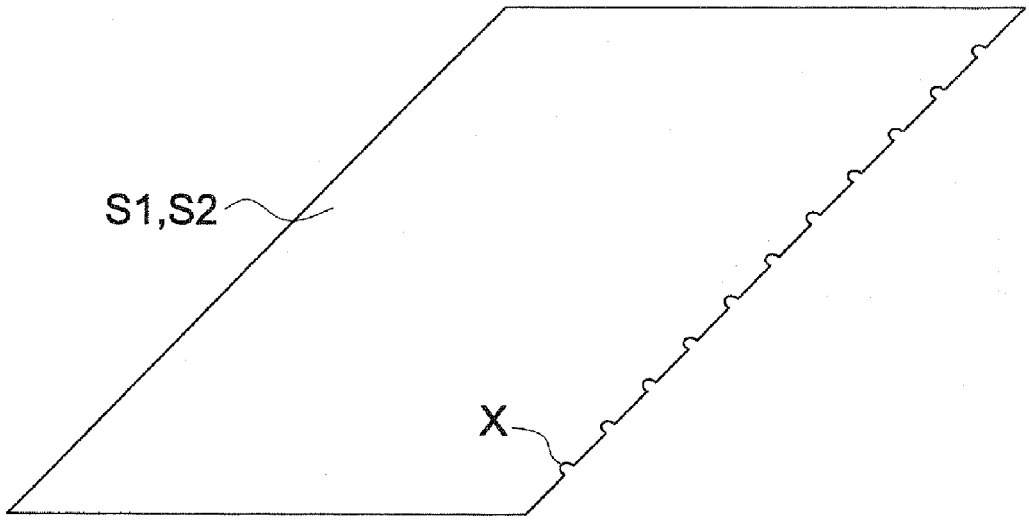
FIGS. 5(*a*) and 5(*b*) show sheets on which the notching process has been conducted.
Figure 5:
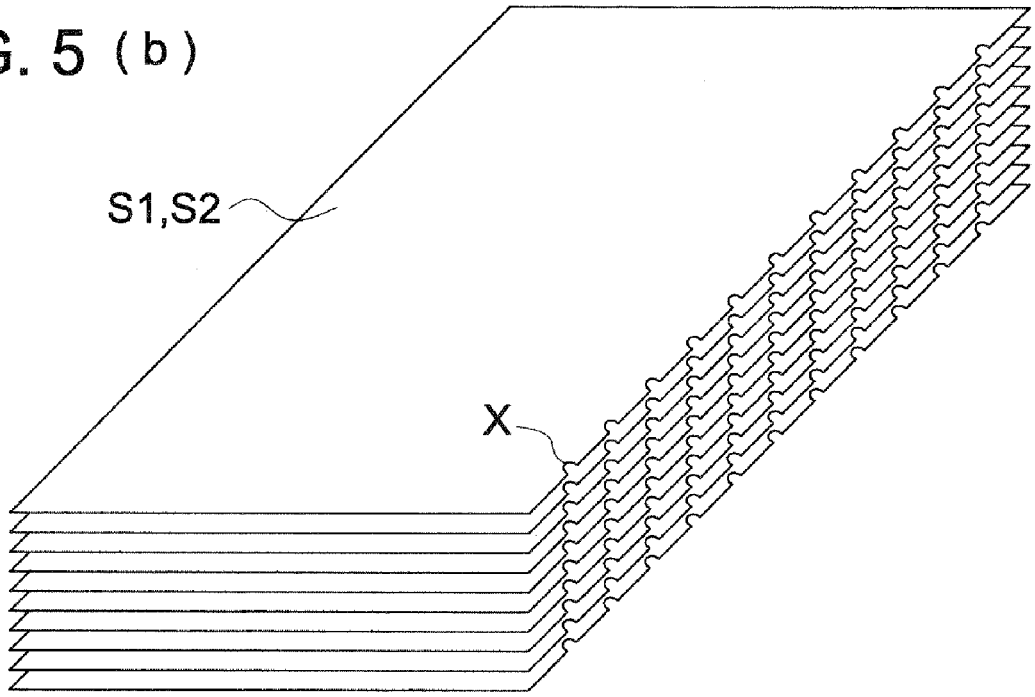

FIGS. 5(*a*) and 5(*b*) show sheets on which the notching process has been conducted.

FIG. 5(*a*) is a perspective view of a single sheet S1 or S2 on which half round notches X have been formed, while FIG. 5(*b*) is a perspective view of a sheet bundle which is structured of plural sheets S1 and S2, each carrying half round notches X.

The notching process is conducted on sheets S1 and S2 so that sheets S1 and S2, and cover CO can be more securely adhered to each other as booklet MA.

A plurality of punches 201B are aligned perpendicular to the conveyance direction of sheets S1 and S2 so that a plurality of notches X can be formed on the edges of sheets S1 and S2. Accordingly, when adhesive is applied onto the end portion of the sheet bundle by bookbinding apparatus C, a large amount of the adhesive enters said notches X, which increase the adhesive force between sheets S1 and S2, and cover CO. In addition, it is possible to structure a bookbinding system in which any number of punches 201B is set, and punches 201B are moved perpendicular to the conveyance direction of sheets S1 and S2 so that notches X can be formed at any position. In the present structure, an individual sheet is notched, whereby the notches are formed by relatively small force, and a large-sized notching section is not necessary.

Figure 6:
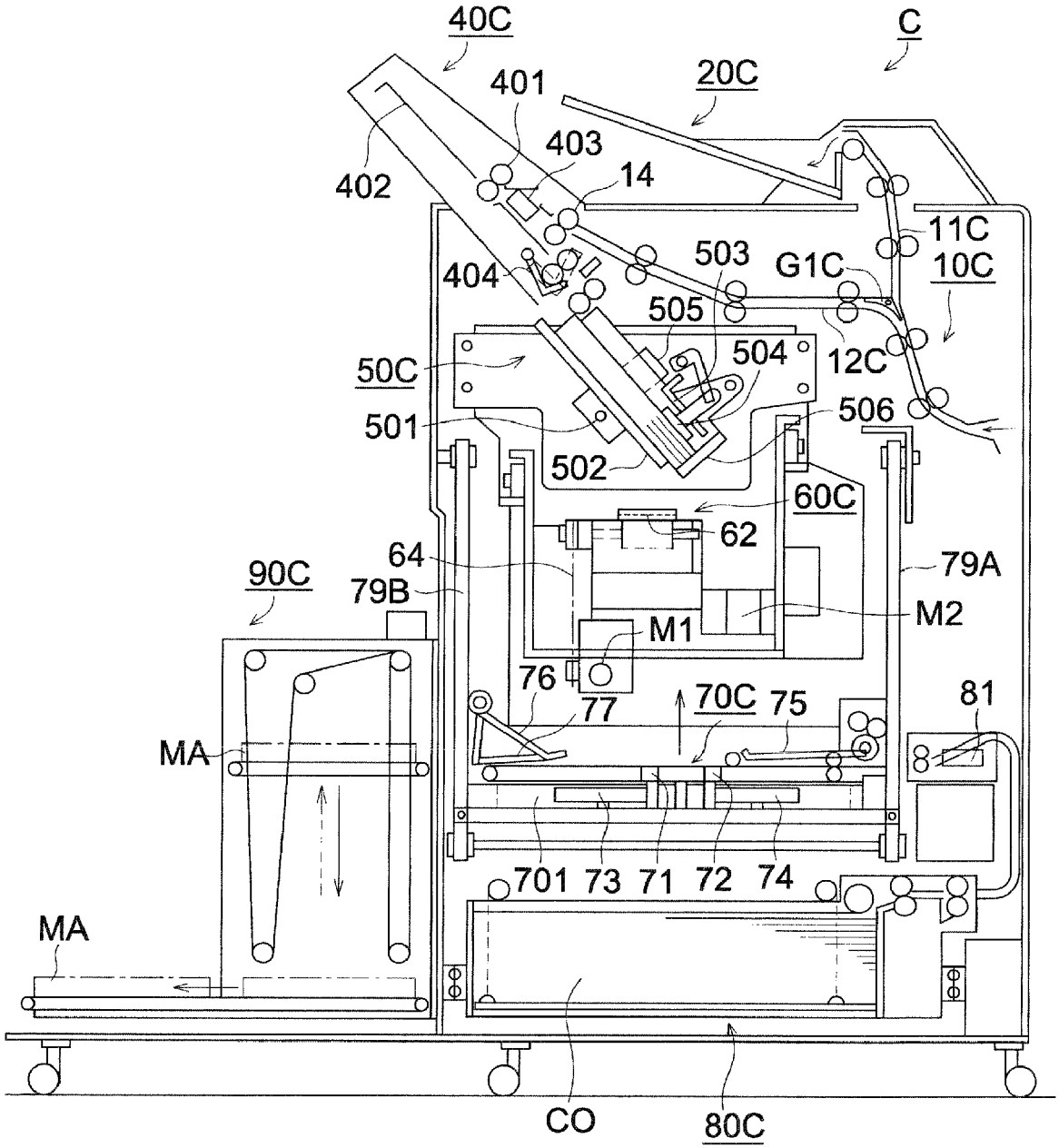
FIG. 6 shows a total structure of a bookbinding apparatus relating to the present invention.

FIG. 6 shows the total structure of bookbinding apparatus C.

Sheets S1 and S2, conveyed through conveyance route 12C, are once ejected onto reversing guide 402 through paired ejection rollers 14 and paired conveyance rollers 401. Sheets S1 and S2, ejected onto reversing guide 402, are aligned by alignment member 403 in a direction perpendicular to the conveyance direction. Stopper 404 is movable between the solid-line position and the dash-line position. While a preceding sheet bundle, structured of sheets S1 and S2, remains at stacking section 50C, stopper 404 moves to the dashed-line position, so that following sheets S and S2 are temporarily stacked on reversing guide 402. After said preceding sheet bundle, structured of sheets S1 and s2, is ejected from stacking section 50C, stopper 404 moves to the solid-line position, so that sheets S1 and S2, which were temporarily stacked on reversing guide 402, fall down onto stacking section 50C.

Sheets S1 and S2 are supported in a slanted orientation in stacking section 50C which incorporates supporting plate 502 and receiving plate 506. Said slanted sheets S1 and S2 are prevented from moving upward by pressing member 504, and are aligned by alignment plate 505. Next, holding plate 503 holds the sheet bundle structured of sheets S1 and S2, after which stacking section 50C holding said sheet bundle rotates on pivoting shaft 501, whereby said sheet bundle changes its state from the slanted orientation to the vertical orientation.

Figure 7:
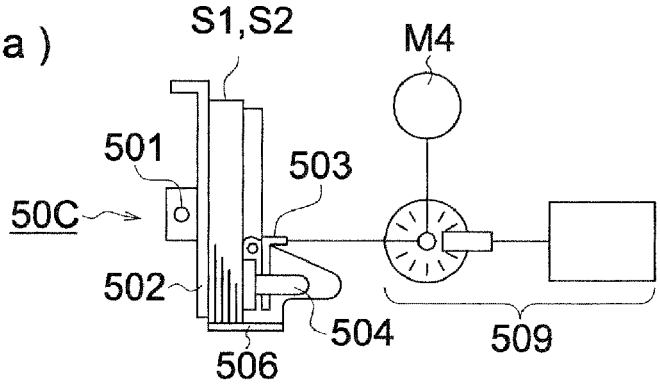
FIGS. 7(*a*)-7(*d*) show the procedure for coating adhesive onto the lower surface of a sheet bundle.
Figure 7:
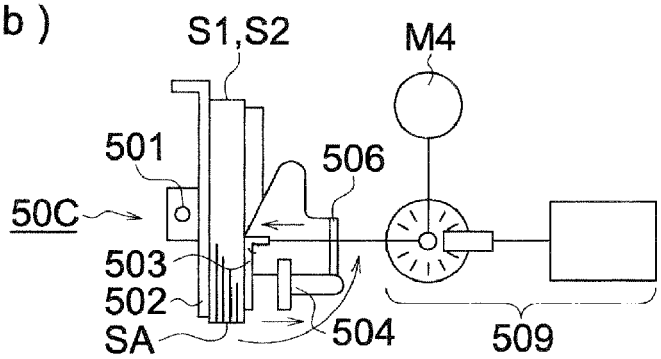
Figure 7:
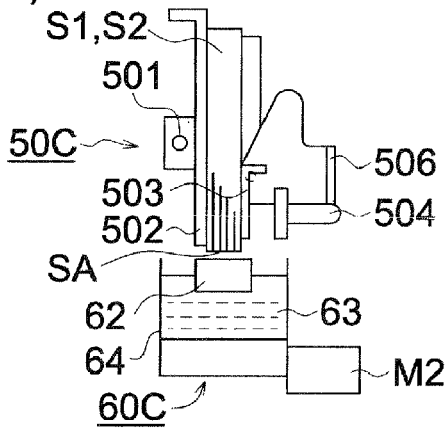
Figure 7:
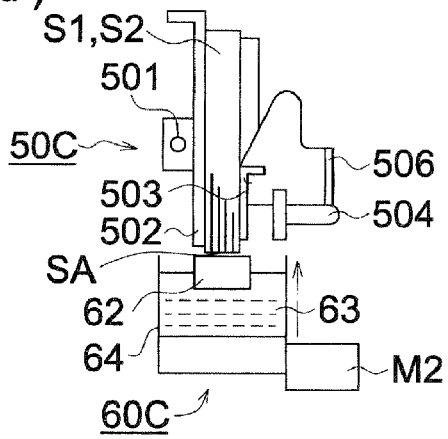

FIGS. 7(*a*)-7(*d*) show the procedure for coating adhesive onto the lower surface of the sheet bundle, structured of sheets S1 and S2.

Holding plate 503 is driven towards sheets S1 and S2 by motor M4. When holding plate 503 comes to press against sheets S1 and S2 with a predetermined force, a driving torque sensor, not shown, detects the increase of the driving torque for motor M4, so that holding plate 503 stops. By this structure, the sheet bundle, structured of sheets S1 and S2, is firmly sandwiched between supporting plate 502 and holding plate 503. The moving length of holding plate 503 is measured by encoder 509, and the measured value is stored in a memory section, such as RAM 303.

In the above state, that is, when the sheet bundle, structured of sheets S1 and S2, have been firmly sandwiched between supporting plate 502 and holding plate 503, receiving plate 506 is rotated to withdraw by 90° as shown in FIG. 7(*b*), by a rotating mechanism (which is not shown). When receiving plate 506 has been completely withdrawn, lower surface SA (being the end portion), of the sheet bundle which is structured of sheets S1 and S2, is separated from coating roller 62 [See FIG. 7(*c*)].

Next, as shown in FIG. 7(*d*), coating section 60C which stores adhesive 63 is raised so that coating roller 62 carrying adhesive 63 comes into contact with lower surface SA. After that, coating section 60C moves along lower surface SA, whereby adhesive 63 is applied onto the total area of lower surface SA.

As described above, the roller is used for a member for coating the lower surface with the adhesive, however, a belt or a brush would also be usable for the member, if they do not go beyond the bounds of the present invention. Said member is requested to be high heat-conductivity to keep the adhesive in the melted condition before coating, whereby a roller is preferable, since it can evenly coat the lower surface with the melted adhesive.

Figure 8:
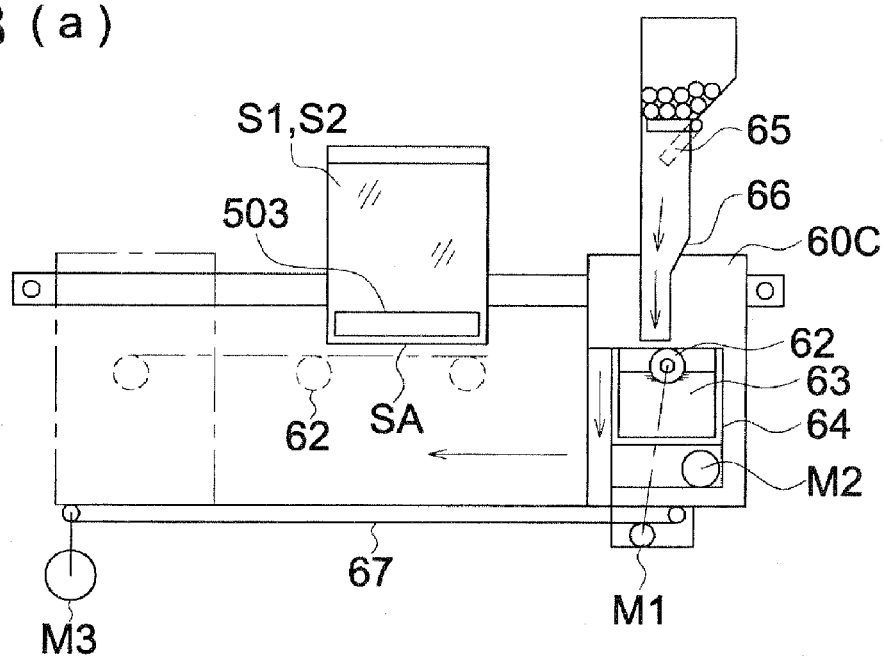
FIGS. 8(*a*) and 8(*b*) show the adhesive coating operation conducted by an adhesive coating section.
Figure 8:
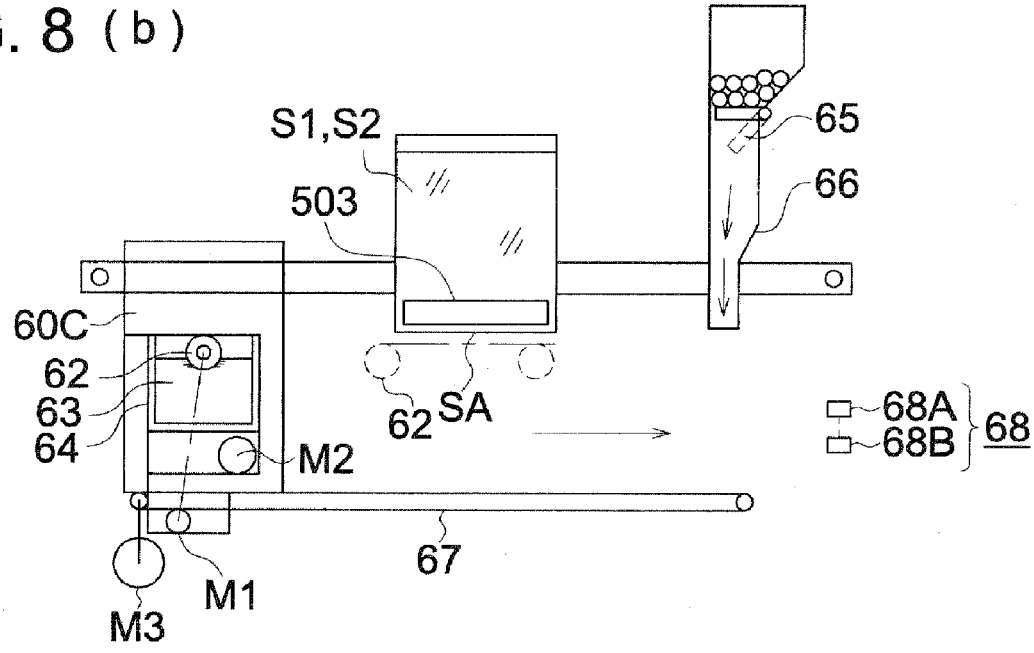

The coating operation to coat lower surface SA with adhesive 63, conducted by coating section 60C, will be detailed while referring to FIG. 8.

Coating section 60C includes coating roller 62 to coat lower surface SA with melted adhesive 63, adhesive storing section 64 to store melted adhesive 63, and a heater, not shown, to melt solid adhesive pellets 63. Solid adhesive pellets 63, are stored in adhesive container 66. When the remaining amount of solid adhesive 63 in coating section 60C becomes less, moving member 65 opens so that solid adhesive pellets 63 drop into coating section 60C, where solid adhesive pellets 63 are melted by the heater.

At the starting step of the bookbinding process, coating section 60C is positioned at the right side in FIG. 8(*a*), which is an initial position. Said position is in the back of bookbinding apparatus C, that is, mounted at the deepest position of FIG. 1. Position detecting sensor 68, including light emitting element 68A and light receiving element 68B, is mounted at the rightmost position of FIG. 8(*b*). if position detecting sensor 68 detects a portion of coating section 60C between light emitting element 68A and light receiving element 68B, it is understood that coating section 60C is at the initial position.

When the bookbinding process is started, coating section 60C is moved due to belt 67 driven by motor M3, from the right position toward the left position, which is at the front position in bookbinding apparatus C. While coating section 60C is moved toward the left position, coating roller 62 is separated from lower surface (being the end portion) SA of the sheet bundle structured of plural sheets S1 and S2. After that, when coating section is moved from the left position toward the right position, which is shown in FIG. 8(*b*), coating roller 62 is raised by motor M2, so that coating roller 62 comes into contact with lower surface SA, onto which adhesive 63 is applied. Coating roller 62 is rotated by motor M1 and is moved as shown by the dashed lines in FIGS. 8(*a*) and 8(*b*), whereby the total area of lower surface SA is coated with melted adhesive 63. The adhesive coating operation may be a one-way movement or a reciprocating movement of coating roller 62.

Figure 9:
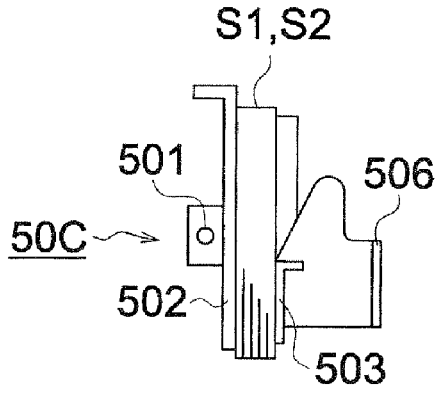
FIGS. 9(*a*)-9(*c*) show the procedure for connecting a cover sheet to the lower surface of the sheet bundle.
Figure 9:
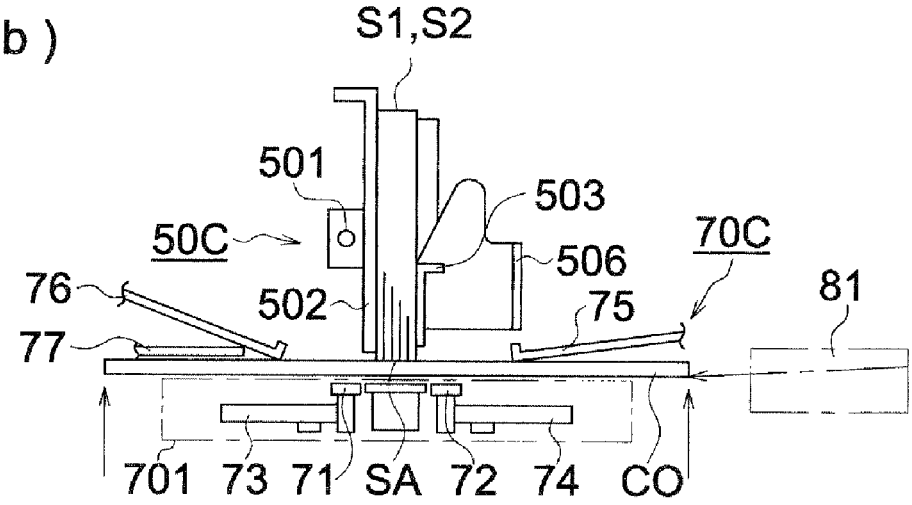
Figure 9:
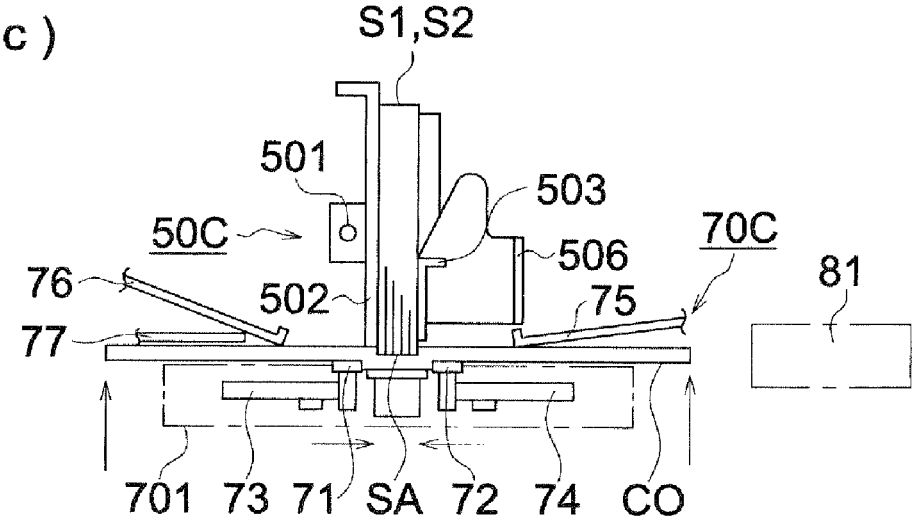

FIGS. 9(*a*)-9(*c*) show the procedure for connecting cover sheet CO to lower surface SA of the sheet bundle.

Cover sheets CO are stored in cover sheet storing section 80C which is provided at the bottom of book binding apparatus C as shown in FIG. 1, and cover sheet CO is sequentially ejected by paired rollers. Cover sheet CO is trimmed by cutter 81 to be an adequate size as a cover sheet, and is placed horizontally on cover sheet supporting section 701. Cover sheet supporting section 701, which is shown by the chained lines in FIGS. 9(*b*) and 9(*c*), is structured of pressing members 71 and 72, cams 73 and 74 to drive pressing members 71 and 72, and the like. Cutter 81 trims cover sheet CO so as to meet a predetermined size, based on size information of sheets S1 and S2, as well as thickness information of the same.

FIG. 9(*a*) shows a state in which the operation to coat adhesive 63 has been completed. In said state, cover sheet supporting section 701 is separated downward from the lower surface of the sheet bundle structured of sheets S1 and S2, where cover sheet supporting section 701 supports cover sheet CO, which is shown in FIG. 6.

As a next step, cover sheet supporting section 701 is raised due to belts 79A and 79B which are shown in FIG. 6, whereby cover sheet CO comes into contact with lower surface SA of the sheet bundle structured of sheets S1 and S2, wherein lower surface SA is the surface on which adhesive 63 is going to be coated. Cover sheet holding members 75, 76 and 77 move vertically with cover sheet supporting section 701. Accordingly, as shown in FIG. 9(*b*), when cover sheet supporting section is moved upward, cover sheet holding members 75, 76 and 77 hold cover sheet CO from above, to keep cover sheet CO in the flat condition.

After that, cover sheet supporting section 701 is additionally raised at a few mm from the position shown in FIG. 9(*b*). FIG. 9(*c*) shows said raised position. Pressing members 71 and 72 press cover sheet CO from both sides to form a spine, whereby 90° angles are formed at the corner between the spine and the front cover, as well as at the corner between the spine and the rear cover, so that cover sheet CO is adhered to sheets S1 and S2 to become completed booklet MA.

Folding apparatus B and bookbinding apparatus C have been detailed as above while referring to FIGS. 3-9. In bookbinding system 1 relating to the present invention, image forming section 100A is provided upstream of merging point G for sheet S1 and sheet S2 with respect to the sheet conveyance direction, while sheet punching section 20B is provided downstream of merging point G for sheet S1 and sheet S2 with respect to the sheet conveyance direction. Further, bookbinding apparatus C is provided downstream of sheet punching section 20B with respect to the sheet conveyance direction. Due to this construction, after sheets S1 and S2 have been notched, sheet S2 carrying no image, is inserted between sheets S1 carrying images, so that a booklet with sheets S1 and S2 can be formed. Further, a booklet can be formed of notched sheets S2 carrying no image, excluding sheet S1 carrying image. Accordingly, various types of booklets MA can be produced by bookbinding system 1. Additionally, since the notches are formed on the edges of sheet S1 and S2, greater adhesive force between sheets S1 and S2 and cover sheet CO is obtained on produced booklet MA.

Control for producing booklet MA will be detailed below.

Figure 10:
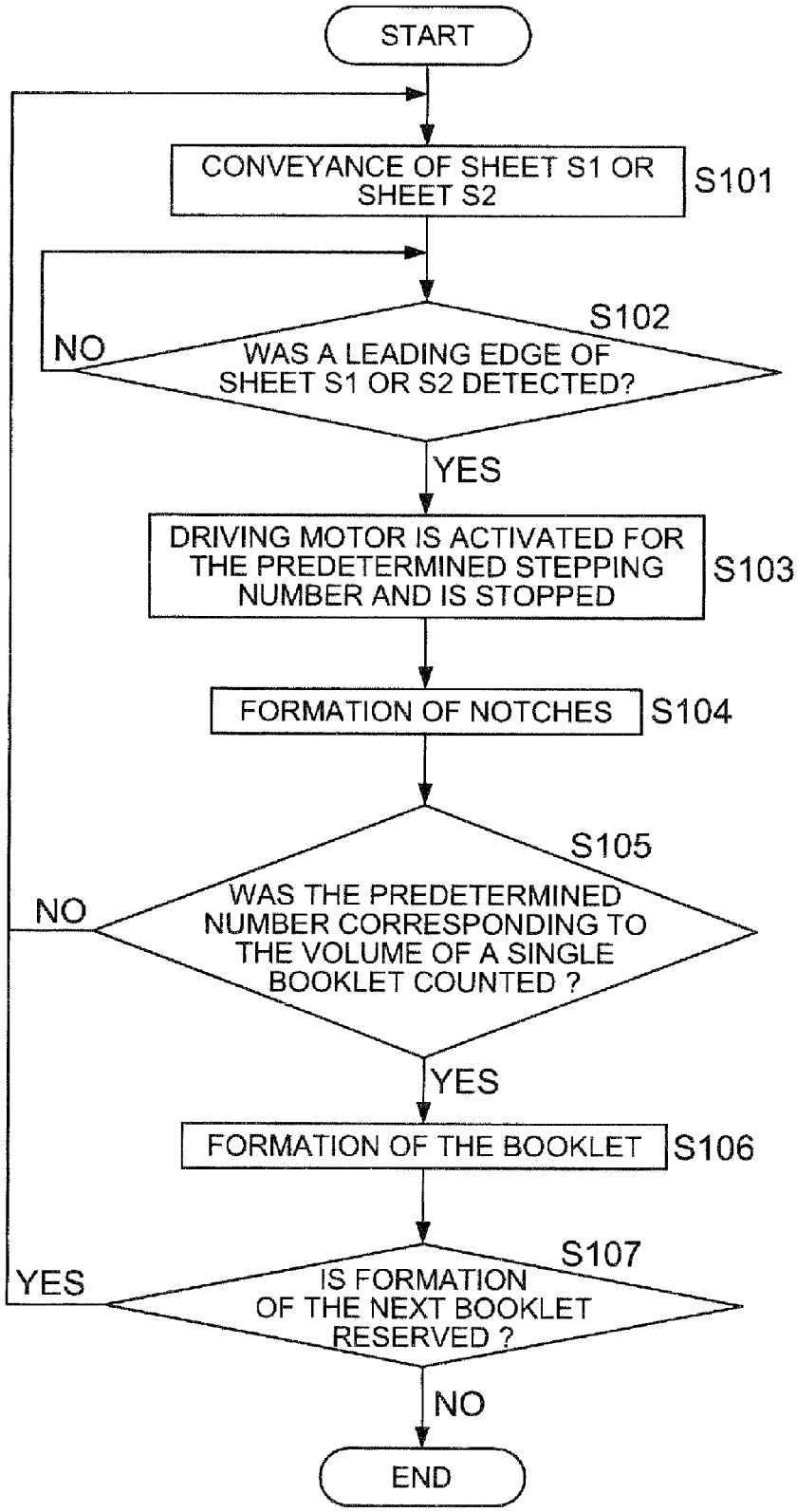
FIG. 10 is a flow chart to show the operation of the bookbinding system, which includes the procedures from notching the edge of sheet to producing a booklet.
Figure 11:
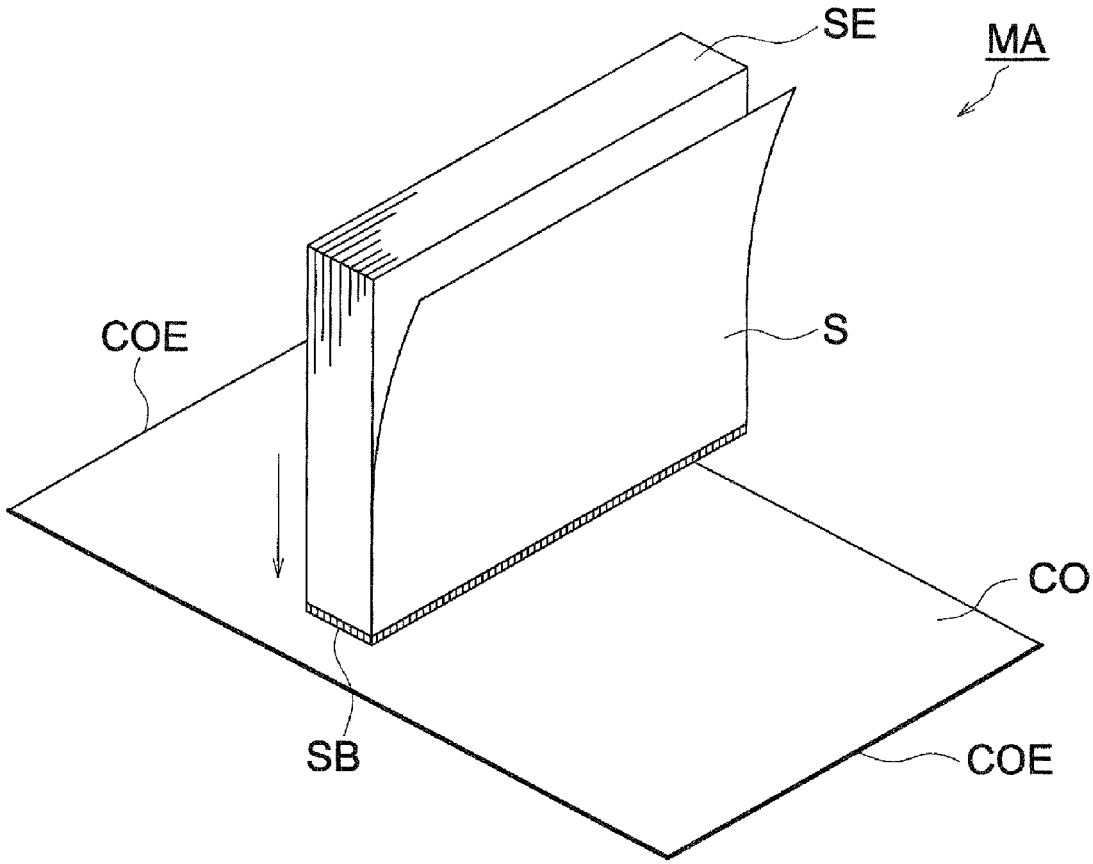
FIGS. 11(*a*) and 11(*b*) show an example of a booklet structured of the sheet bundle and the cover sheet.
Figure 11:
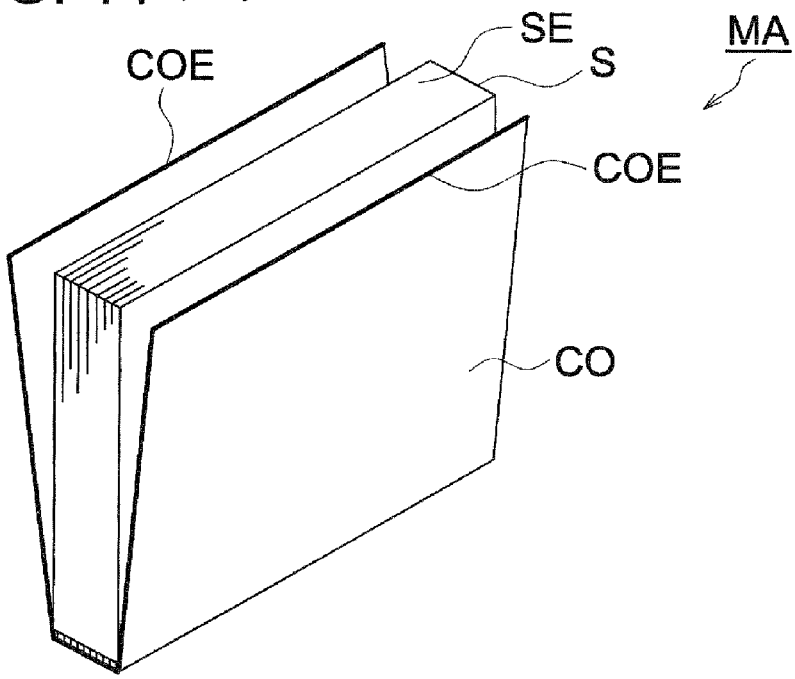

FIG. 10 is a flow chart to show the operation of bookbinding system 1, wherein the operation includes the procedure from forming the notches on the edges of sheets S1 and S2 to producing a complete booklet.

The successive operation shown in FIG. 10 are conducted by CPUs 101, 201 and 301 which work with ROMs 102, 202, and 302, and RAMs 103, 203 and 303.

When the bookbinding job is started, sheets S1 stored in image forming apparatus A, or sheets S2 stored in folding apparatus B, is conveyed (being step S101). Selection to convey either sheet S1 or sheet S2 is determined based on attributed information of the job to be conducted.

If the bookbinding job to be conducted is a bookbinding work of booklet MA, in which sheets S1 carrying images formed by image forming apparatus A, and sheets S2 set in folding apparatus B, are to be mixed, sheet S1 and sheet S2 are sequentially conveyed to sheet punching section 20B of folding apparatus B, based on page information of the job to be conducted.

Further, if the bookbinding job to be conducted is a bookbinding work of booklet MA, in which sheets S1 carrying images formed by image forming apparatus A, are to be used, after sheets S1 is conveyed to obtain the image formation, said sheets S1 is sequentially conveyed to sheet punching section 20B of folding apparatus B.

Still further, if the bookbinding job to be conducted is a bookbinding work of booklet MA, in which sheets S2 which have been set in folding apparatus B, are to be used, sheet S2 is sequentially conveyed to sheet punching section 20B of folding apparatus B.

When sheet S1 or sheet S2 is conveyed in step S101, sheet detection sensor 30B of folding apparatus B works to detect the leading edge of sheet S1 or S2 (which is step S102).

When the leading edge of sheet S1 or S2 has been detected by sheet sensor 30B (step S102: YES), a drive motor provided in folding apparatus B is stepped to convey sheet S1 or S2, and is stopped at the predetermined step number, whereby sheet S1 or S2 is stopped at the position where the punching operation is conducted by sheet punching section 20B (step S103). Subsequently, punches 201B are activated to make notches on the edges of sheets S1 and S2 (step S104).

Sheets S1 and S2 having notches X are conveyed to bookbinding apparatus C, and are ejected onto reversing guide 402, whereby the predetermined number of sheets S1 and S2 are counted to complete a single booklet (step S105). In this case, a sensor, mounted on a conveyance route which is upstream of reversing guide 402, counts said number.

When said sensor has counted the predetermined number of sheets S1 and S2, cover sheet CO is adhered onto the sheet bundle structured of sheets S1 and S2, so that booklet MA is produced (step S106).

If a next bookbinding work is on stand-by, the operations in steps S101-S106 are repeated to produce a plurality of booklets MA.

As described above, while referring to the flow chart in FIG. 10, based on the instruction of the bookbinding job set by the operator, sheets S1 and S2 are selected and conveyed to bookbinding apparatus C, whereby the notching operation is conducted onto sheets S1 and S2, so that booklet MA is produced after cover sheet CO is adhered.

The present invention is not limited to the embodiments described above, and the present invention includes alternations or additions conducted within the summary of the present invention.

In addition, the shape of notch X shown in FIG. 3 is not limited to a half circle, and other shapes can be used.

Further, in bookbinding system 1 shown in FIG. 1, three apparatuses, being image forming apparatus A, folding apparatus B, and bookbinding apparatus C, are combined, but a single apparatus, uniting said three apparatuses into a single one, is also in the category of the present invention.

What is claimed is:

1. A bookbinding system to produce booklets, comprising:

an image forming section which forms an image on a sheet;

a first conveyance route serving as a conveyance route of the sheet on which the image has been formed by the image forming section;

a sheet storing section which stores sheets on which no image is to be formed by the image forming section;

a second conveyance route serving as a sheet conveyance route to connect the sheet storing section and the first conveyance route;

a notch forming section which forms notches on edges of conveyed sheets; and a bookbinding section which accumulates the conveyed sheets to form a sheet bundle, and adheres a cover sheet to the sheet bundle to form a booklet, wherein the image forming section is positioned upstream of a merging point of the first conveyance route and the second conveyance route, with respect to a sheet conveyance direction of the first conveyance route, wherein the notch forming section is positioned downstream of the merging point, with respect to the sheet conveyance direction;

wherein a position of the conveyed sheet is changed under the notch forming section such that one of (i) a punching process to form round holes is selected and (ii) a notching process to form half round notches is selected, and wherein the bookbinding section is positioned downstream of the notch forming section, with respect to the sheet conveyance direction.

2. The bookbinding system of claim 1, further comprising a control section to control the bookbinding system, wherein when the bookbinding system produces a booklet in such a way that after the sheet carrying the image formed by the image forming section and the sheet stored in the sheet storing section are bundled as the sheet bundle, and the cover sheet is adhered to the sheet bundle by the bookbinding section, the control section controls the bookbinding system in such a way that the sheet carrying the image formed by the image forming section and the sheet stored in the sheet storing section are sequentially conveyed to the notch forming section based on page information of a job, and after the notches are formed on the edges of the sheets, the notched sheets are conveyed to the bookbinding section.

3. The bookbinding system of claim 1, further comprising a control section to control the bookbinding system, wherein when the bookbinding system produces a booklet in such a way that after the sheets carrying the image formed by the image forming section are bundled as the sheet bundle, and the cover sheet is adhered to the sheet bundle by the bookbinding section, the control section controls the bookbinding system in such a way that the sheets carrying the image formed by the image forming section are sequentially conveyed to the notch forming section, and after the notches are formed on the edges of the sheets, the notched sheets are conveyed to the bookbinding section.

4. The bookbinding system of claim 2, wherein when the bookbinding system produces a booklet in such a way that after the sheets carrying the image formed by the image forming section are bundled as the sheet bundle, and the cover sheet is adhered to the sheet bundle by the bookbinding section, the control section controls the bookbinding system in such a way that the sheets carrying the image formed by the image forming section are sequentially conveyed to the notch forming section, and after the notches are formed on the edges of the sheets, the notched sheets are conveyed to the bookbinding section.

5. The bookbinding system of claim 1, further comprising a control section to control the bookbinding system, wherein when the bookbinding system produces a booklet in such a way that after the sheets stored in the sheet storing section are bundled as the sheet bundle, and the cover sheet is adhered to the sheet bundle by the bookbinding section, the control section controls the bookbinding system in such a way that the sheets stored in the sheet storing section are sequentially conveyed to the notch forming section, and after the notches are formed on the edges of the sheets, the notched sheets are conveyed to the bookbinding section.

6. The bookbinding system of claim 2, wherein when the bookbinding system produces a booklet in such a way that after the sheets stored in the sheet storing section are bundled as the sheet bundle, and the cover sheet is adhered to the sheet bundle by the bookbinding section, the control section controls the bookbinding system in such a way that the sheets stored in the sheet storing section are sequentially conveyed to the notch forming section, and after the notches are formed on the edges of the sheets, the notched sheets are conveyed to the bookbinding section.

7. The bookbinding system of claim 3, wherein when the bookbinding system produces a booklet in such a way that after the sheets stored in the sheet storing section are bundled as the sheet bundle, and the cover sheet is adhered to the sheet bundle by the bookbinding section, the control section controls the bookbinding system in such a way that the sheets stored in the sheet storing section are sequentially conveyed to the notch forming section, and after the notches are formed on the edges of the sheets, the notched sheets are conveyed to the bookbinding section.

8. The bookbinding system of claim 4, wherein when the bookbinding system produces a booklet in such a way that after the sheets stored in the sheet storing section are bundled as the sheet bundle, and the cover sheet is adhered to the sheet bundle by the bookbinding section, the control section controls the bookbinding system in such a way that the sheets stored in the sheet storing section are sequentially conveyed to the notch forming section, and after the notches are formed on the edges of the sheets, the notched sheets are conveyed to the bookbinding section.

* * * * *